US006032748A

United States Patent [19]

DeBray et al.

[11] Patent Number: 6,032,748

[45] Date of Patent: Mar. 7, 2000

[54] NON-ROTATABLE STABILIZER AND TORQUE REDUCER

[75] Inventors: Harold J. DeBray, The Woodlands; George C. McKown, Spring; Charles H. Dewey, Houston, all of Tex.

[73] Assignee: Smith International, Inc., Houston, Tex.

[21] Appl. No.: 08/870,707

[22] Filed: Jun. 6, 1997

[51] Int. Cl.[7] ..... E21B 17/10

[52] U.S. Cl. ..... 175/325.7; 175/325.5; 175/325.1; 175/325.3; 166/241.4; 166/241.6

[58] Field of Search ..... 175/325.1, 325.3, 175/325.5, 325.7, 325.6; 166/241.4, 241.6, 241.7; 285/45

[56] References Cited

U.S. PATENT DOCUMENTS

| | | | |
|---|---|---|---|
| 2,368,415 | 1/1945 | Grant | 175/325.7 |
| 4,000,549 | 1/1977 | Brumley et al. | 175/325.5 |
| 4,411,458 | 10/1983 | Strunk et al. | 285/196 |
| 4,793,638 | 12/1988 | Baldwin, Jr. | 285/148.13 |
| 4,984,633 | 1/1991 | Langer et al. | 175/325.5 |
| 5,579,854 | 12/1996 | Barry | 175/325.6 |

OTHER PUBLICATIONS

Drilco (Division of Smith International, Inc.); 1984–'85 Composite Catalog; (2 p).

Drilco (Division of Smith International, Inc.); Non–Rotating Sleeve–Type Stabilizer; (undated); (2 p.).

Security DBS; Drill String Torque Reduction Sub; (undated); (4 p.).

Technology; Drillstring Sub Cuts Torque and Casing Wear; Oil & Gas Journal; Oct. 14, 1996; (7 p.).

Composite Catalog; vol. 2; 41st Edition 1994–95; Published by World Oil; (6 p.).

*Primary Examiner*—David Bagnell
*Assistant Examiner*—Chi H. Kang
*Attorney, Agent, or Firm*—Conley, Rose & Tayon, P.C.

[57] ABSTRACT

An exemplary stabilizer and torque reducer which will engage a wellbore casing and locate the drill string substantially toward the concentric center of the wellbore casing. The device is capable of being affixed to a drill string at most any location along the string and features a wear sleeve formed of two mateable semicylindrical halves. Malleable bushings are disposed between the wear sleeve and the drill pipe to prevent damage to the drill pipe. The wear sleeve presents an outer wear surface upon which is disposed a stabilizer housing having a plurality of outwardly radially-extending blades adapted to contact a surface such as surrounding wellbore casing. In use, the stabilizer housing is intended to be non-rotatable with respect to the casing when in contact with the casing, but will rotate with respect to the drill string. The housing is of a durable construction having an elastomer jacket with a reinforcing insert within. The presence of the wear sleeve protects the drill pipe from wear which could result from friction due to rotation of the stabilizer housing directly upon the drill pipe.

27 Claims, 5 Drawing Sheets

30
28
44
16
34
24
46
40
62
44
40
38
56
58
58
58
68
60
50
67
14
70
64
60
60
66
10
72
52
32
38
32
26
46
40
44
24
18
36
12

NON-ROTATABLE STABILIZER AND TORQUE REDUCER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to drill pipe stabilizers or torque reducers used with drill strings. Additionally, the invention relates to devices used to protect wellbore casing.

2. Description of Related Art

During drilling operations, contact between the drill string and wellbore casing results in undesirable friction and off-bottom torque forces, which are applied against the drill string. This torque reduces drilling effectiveness and may result in damage to the drill string if the torque is particularly high or sustained for a long period of time. When a drill string is disposed into a deviated well, such as during an extended reach drilling operation, portions of the drill pipe tend to come into contact with the casing at points where the wellbore deviates. At these points of contact, the rotating drill string causes wear and damage to occur on the drill string. Rotation of the drill string also tends to wear the casing thus reducing wall thickness and casing strength. Ultimately, this type of wear can cause holes to develop in the casing. In some cases, drilling operations need to be stopped for emplacement of casing patches over the holes.

Devices known as drill pipe stabilizers or torque reducers are used during drilling in wellbores to protect the well casing. These devices are used to surround portions of the drill pipe and are intended to protect the drill pipe from the damaging torques and wear that can occur from rotation of the drill pipe against the casing. Unfortunately, most known stabilizers are either difficult to attach and to remove from a drill string, or they result in often unwanted additional length to the drill string. Further, conventional stabilizers often fail to adequately protect the drill string. Because most current designs affix the stabilizer directly to the drill pipe itself, wear occurs on the drill pipe during drilling operations.

Additional length results from the use of separate stabilizer or torque reduction subs that are incorporated into the tool string by separating the string at a tool joint, inserting the sub and reassembling the drill string. These subs typically consist of a mandrel having a surrounding metal sleeve. The sleeve is free to rotate about the sub's mandrel using sealed bearings which are disposed between the sleeve and the mandrel. An example of this type of sub is the Security DBS Drill String Torque Reduction Sub.

One device which became available in the early 1990's is referred to as the nonrotating drill pipe/casing protector (or NDPP). The NDPP consists of a rubber sleeve which is held in place axially on the drill pipe with aluminum thrust collars. The collars are secured to the drill pipe by bolts which clamp it against the drill pipe. One major drawback of this tool is the potential for it to strip, leaving the rubber element downhole with consequential fishing or directional drilling problems.

Smith International also currently markets a non-rotating sleeve-type stabilizer sub. The sub body includes a wear mandrel having a hardened wear surface. An elastomeric sleeve surrounds the wear mandrel. The sleeve is made of a single cylindrical piece and presents either four or six radially outwardly-extending ribs.

SUMMARY OF THE INVENTION

In the present invention, an exemplary stabilizer and torque reducer is described which will engage a wellbore casing and locate the drill string substantially toward the concentric center of the wellbore casing. The device is capable of being affixed to a drill string at most any location along the string. The assembly features a wear sleeve, which is formed of two mateable semicylindrical halves. The halves are bolted together around the drill pipe to secure the wear sleeve upon the drill pipe. Malleable bushings are disposed between the wear sleeve and the drill pipe to prevent damage to the drill pipe from directly clamping a harder metal against the drill pipe. The wear sleeve presents an outer wear surface upon which is disposed a stabilizer housing having a plurality of outwardly radially-extending blades adapted to contact a surface such as surrounding wellbore casing.

In use, the stabilizer housing is intended to be non-rotatable with respect to the casing when in contact with the casing, but will rotate with respect to the drill string. The housing is of a durable construction having an elastomer jacket with a reinforcing insert within. The presence of the wear sleeve protects the drill pipe from wear which could result from friction due to rotation of the stabilizer housing directly upon the drill pipe.

DETAILED DESCRIPTION OF THE PREFERRED EMBODIMENTS

Figure 1:
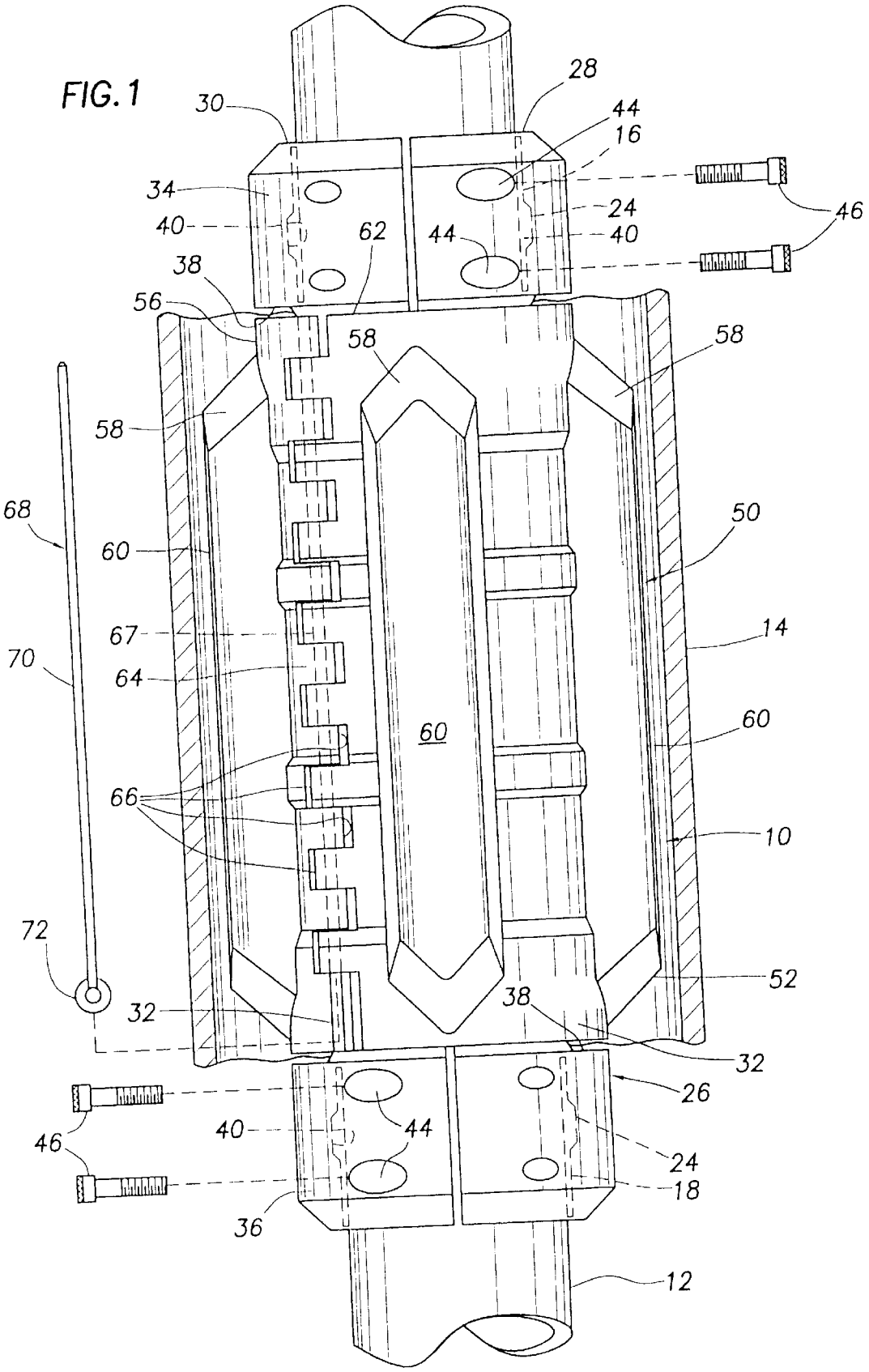
FIG. 1 is an external side view of an exemplary stabilizer assembly constructed in accordance with the present invention and shown affixed to a portion of drill pipe.
Figure 2:
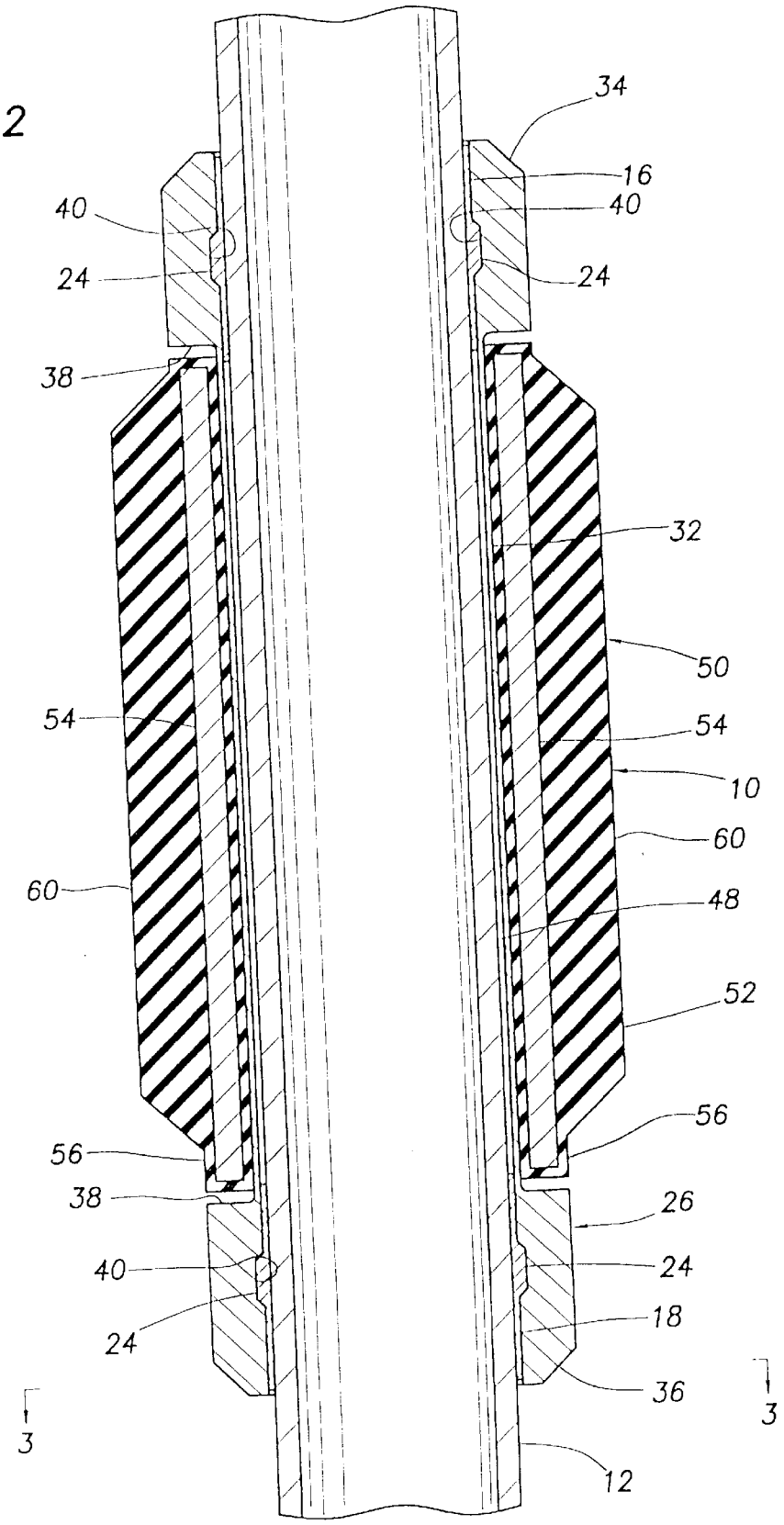
FIG. 2 is a side cross-sectional view of the exemplary stabilizer assembly shown in FIG. 1.
Figure 3:
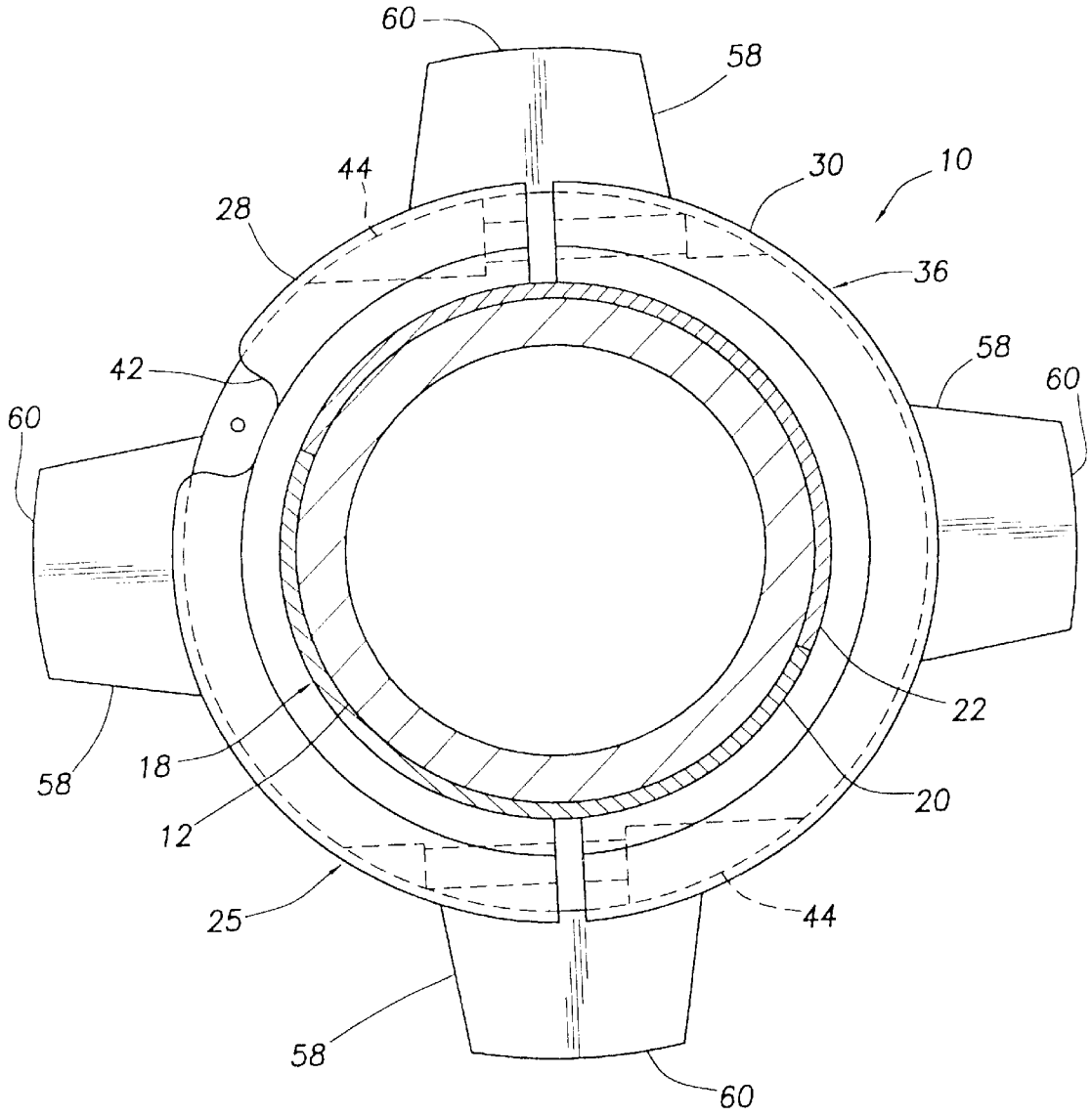
FIG. 3 is a cross-sectional end view of the assembly depicted in FIG. 2 taken along the lines 3—3.

FIGS. 1, 2 and 3 depict an exemplary stabilizer assembly 10 in accordance with the present invention. The assembly 10 is secured to a drill pipe 12 of a type known in the art and which is disposed into a wellbore to support a drilling bit (not shown). In FIG. 1, the drill pipe 12 and stabilizer assembly 10 are shown disposed within a section of cement wellbore casing 14. To power a drilling bit, the drill pipe 12 is rotated about its longitudinal axis within the casing 14 by a drilling rig (not shown) located at the surface of the well. The mechanics of such operations are well known and will not be described in detail here.

As best shown in FIG. 2, the stabilizer assembly 10 includes a pair of bushings 16, 18. The bushings 16, 18 are preferably fashioned from aluminum, copper, brass or a similar material which is softer, or more malleable, than the harder metal forming the drill pipe 12 and that used in the wear sleeve 26 which will be described shortly and other metallic components of the stabilizer assembly 10. The use of a softer, more malleable, material prevents damage to the drill pipe 12, which can occur from directly clamping a harder metal such as steel onto a similar harder metal. Each of the bushings 16, 18 is made up of a pair of mating, semicylindrical halves. FIG. 3's cross-sectional view shows the mating halves 20, 22 for bushing 18. Each of the bushings 16, 18 presents a centrally located radially-outwardly raised ridge 24.

A longitudinal wear sleeve 26 is disposed radially outwardly upon the bushings 16, 18. The wear sleeve is made of a strong, hard metal such as steel. The wear sleeve 26 is also formed of a pair of mating semicylindrical halves 28, 30 which are affixed to each other in a manner which will be described. The wear sleeve 26 features a central wear section 32 which provides a smooth, finished, radially outer surface. The wear sleeve 26 also includes a securing clamp 34, 36 at either axial end. Each of the clamps 34, 36 presents a radially expanded outer circumference which exceeds the circumference presented by the wear section 32. As a result, each clamp 34, 36 provides an axial guide shoulder 38 which is directed toward the wear section 32. The inner radial surface of each clamp 34, 36 includes a recess 40 which is shaped and sized to be complimentary to the raised ridge 24 of the bushings 16, 18. As shown in FIG. 3, an inwardly-disposed external groove or notch 42 is provided in the clamp 36. Threaded screw holes 44 are provided through each of the clamps 34, 36 so that suitable threaded connectors 46 can be used to secure the two halves 28, 30 of the wear sleeve 26 together in a radially surrounding relation upon the bushings 16, 18. When so disposed, a gap 48 (shown in FIG. 2) is left between the wear sleeve 26 and the drill pipe 12 such that the wear sleeve 26 does not contact the drill pipe 12.

Figure 4:
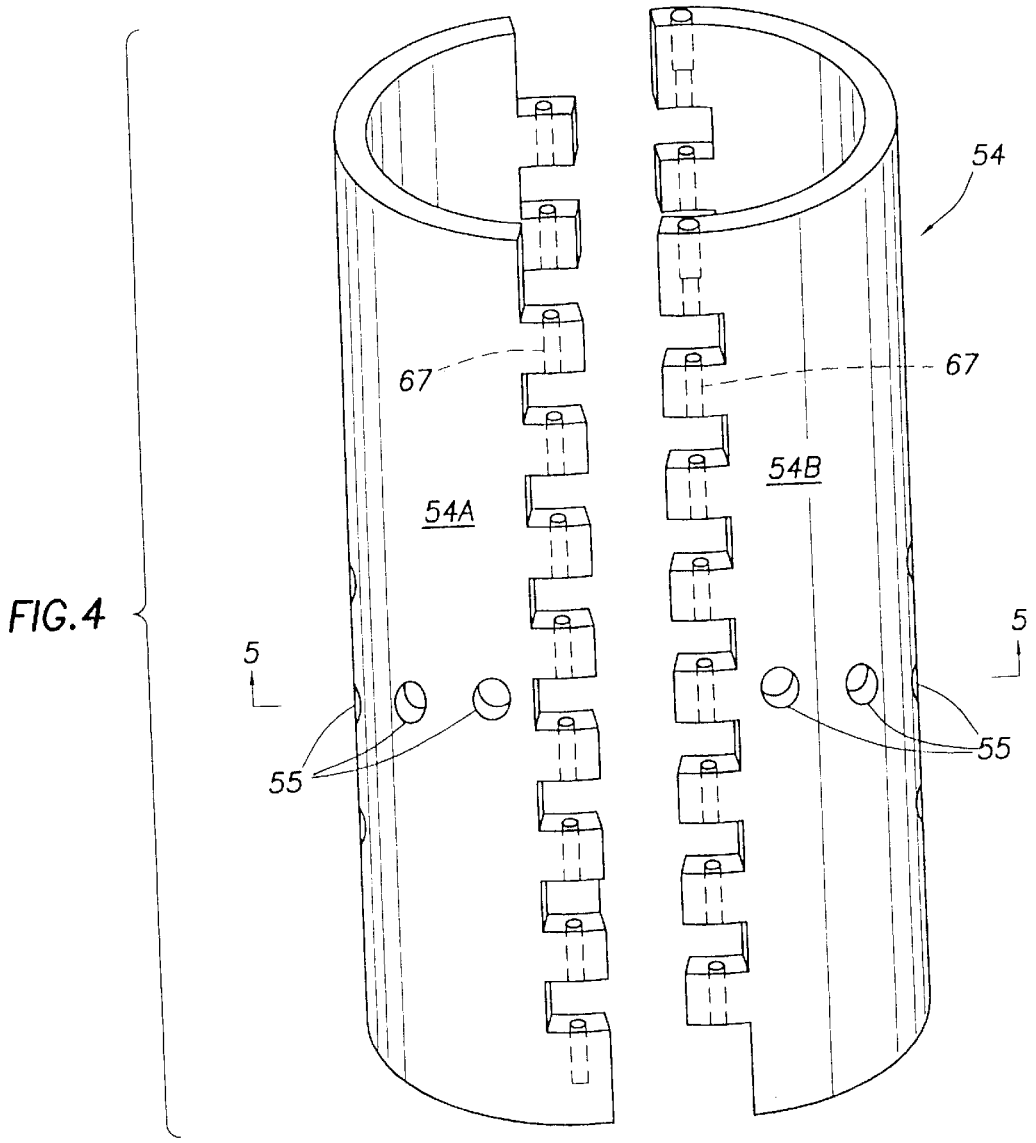
FIGS. 4 and 5 are exploded views of an exemplary insert from the stabilizer housing.
Figure 5:
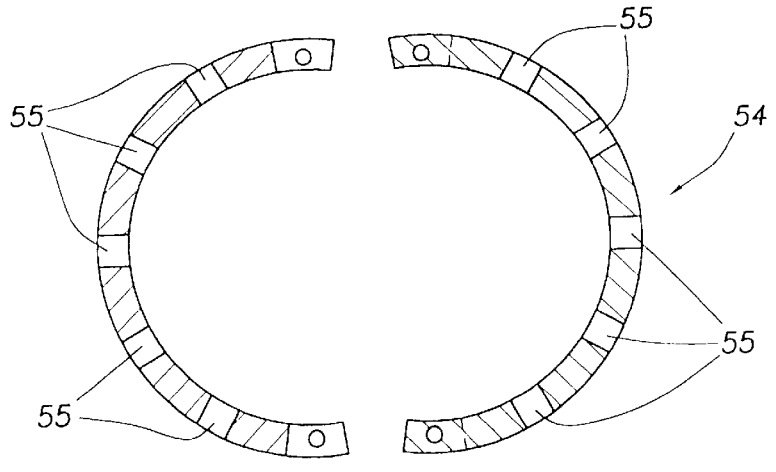

A stabilizer housing 50 is disposed on the radial outer surface of the wear section 32 between the guide shoulders 38. The stabilizer housing 50 is of a composite construction which features an elastomeric jacket 52 surrounding a cylindrical stiffening insert 54. The insert 54 is depicted in an exploded view in FIGS. 4 and 5 devoid of the elastomeric jacket 52. As illustrated there, the insert 54 is made up of two mating insert halves 54A and 54B. The insert halves 54A and 54B each include a plurality of perforations 55 which are disposed about the central circumference of the halves 54A and 54B. When the elastomeric material used to form the jacket 52 is molded about the insert halves 54A and 54B, some of the elastomeric material will enter and fill the perforations 55 thereby helping to securely bond the cured jacket 52 to the insert 54.

Figure 6:
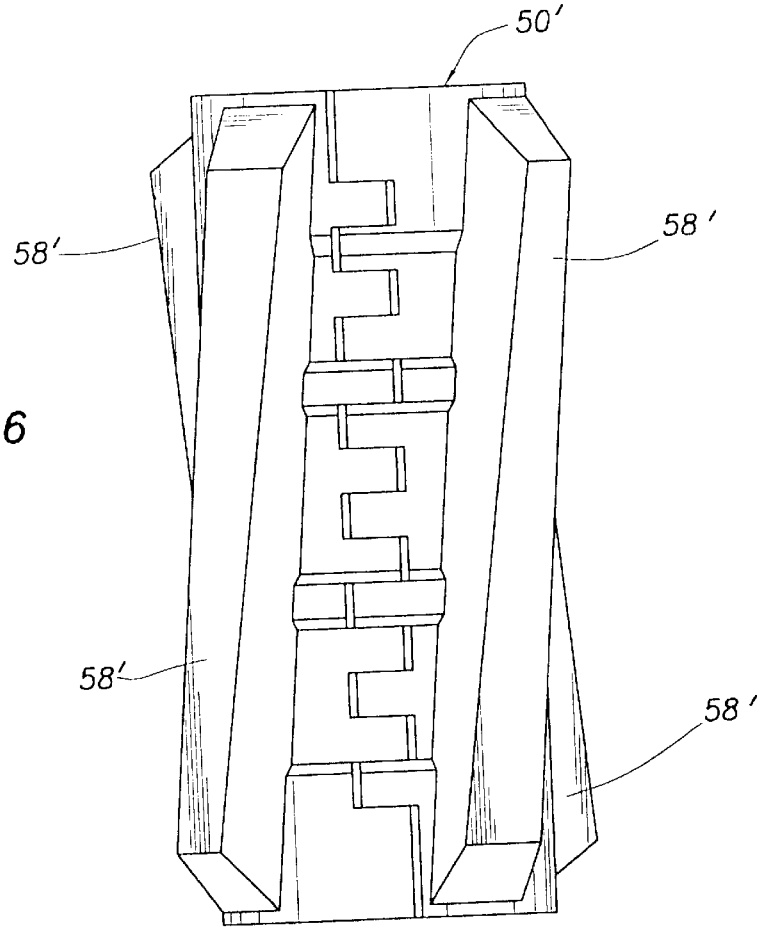
FIG. 6 is an external view of an alternative embodiment of a stabilizer housing having spiral shaped blades.

Structurally, the stabilizer housing 50 consists of a central tubular portion 56 with a plurality of radially outwardly extending blades 58. The central tubular portion 56 is rugged and durable due to the presence of the insert 54. As a result, stripping of the stabilizer housing 50 from the drill pipe 12 is unlikely to occur. In a preferred embodiment, the housing 50 has four blades 58. However, in some cases, it may be desirable to have six or some other number of blades 58. The blades 58 each present a casing-engaging surface 60. In the embodiment shown in FIGS. 1, 2 and 3, the blades 58 are straight and disposed in a parallel relation to the longitudinal axis of the stabilizer housing 50. If desired, the blades of the stabilizer may instead have a spiral configuration, such as the blades 58' on the stabilizer housing 50' depicted in FIG. 6. Indeed, the present invention contemplates that the blades of the stabilizer housing may be of any useful configuration or shape.

The stabilizer housing 50 is formed of a pair of mating semicylindrical halves 62, 64. Preferably, the elastomeric jacket 52 is formed of a durable elastomer such as a nitrile-based rubber or urethane. In a presently preferred embodiment, the elastomer has a durometer hardness of 72. As FIG. 1 shows, the halves 62, 64 each have two edges which present a series of protruding fingers 66 that interlace with complimentary fingers 66 of the other half in the overlapping fashion of the pieces of a door hinge. These fingers 66 contain interior channels 67 in the same manner as a door hinge which are aligned when the fingers 66 of the two halves 62, 64 are interlaced. Securing pins 68 (shown in FIG. 1) are disposed through the aligned channels 67 in the same manner as the pintle of a door hinge. In the embodiment depicted in FIG. 1, the securing pin 68 shown is formed of a long shaft 70 having a washer 72 affixed at one axial end of the shaft 70.

When secured in this manner, the stabilizer housing 50 is disposed on the wear section 32 so that it will rotate relatively freely with respect to the wear sleeve 26. In operation, drilling fluid returns lubricate the contact between the housing 50 and wear section 32 in a marine bearing fashion. The stabilizer housing 50 is maintained in alignment on the wear surface 32 by the presence of the guide shoulders 38.

A stabilizer assembly 10 may be secured at virtually any desired location along a drill pipe. Construction of the stabilizer assembly 10 upon drill string 12 is accomplished as follows. Once a desired location is chosen for emplacement of the stabilizer assembly 10 along the drill string, the bushings 16, 18 are placed in radially-surrounding relation about the drillstring 12. The halves 28, 30 of the wear sleeve 26 are then placed on the bushings 16, 18 such that the ridges 24 of each bushing are located within the recesses 40 of the wear sleeve 26. The connectors 46 are then inserted into the holes 44 and tightened to secure the wear sleeve 26 against the bushings 16, 18. Next, the two halves 62, 64 of the stabilizer housing 50 are placed around the wear surface 32 of the wear sleeve 26 and are secured to each other with securing pins 68. The pins 68 are inserted into the channels 67 formed by the interlocking fingers 66 by passing the pins 68 through the groove 42 of the clamp 18 and into the respective channel 67. The stabilizer assembly 10 may also be removed from the drill pipe 12 by essentially reversing this procedure.

Figure 7:
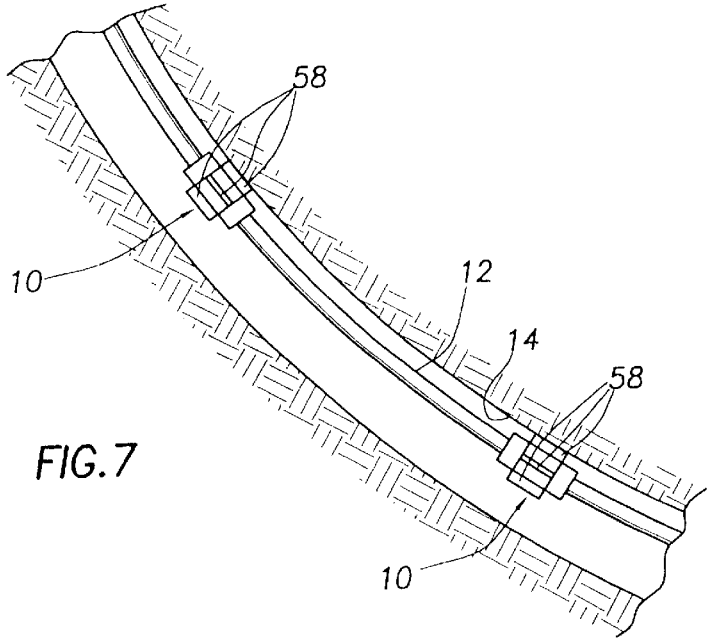
FIG. 7 is a cross-sectional view of a portion of an exemplary drill string disposed within a wellbore and incorporating stabilizer assemblies in accordance with the present invention.

In accordance with the present invention, a number of stabilizer assemblies 10 may be affixed to a section of drill pipe. FIG. 7 depicts an exemplary drillstring 12 disposed within a deviated section of wellbore casing 14. A number of stabilizers 10 are placed along a section of drill pipe 12 at suitable intervals. At points where the drillstring 12 is proximate the casing 14, the contact surfaces 60 of the blades 58 of the stabilizers 10 will engage the casing 14 to maintain the drill pipe 12 at a distance from the surrounding walls of the casing 14 and in a relatively centralized location within the casing 14. With the blades 58 so engaged, the stabilizer housings 50 will cease to rotate with respect to the casing 14. However, the drill pipe 12 and wear sleeve 26 will be rotated within the stabilizer housing 50.

In operation, use of stabilizer assemblies 10 offers significantly reduced off-bottom torque along the length of the drill pipe. The stabilizer jacket 50 is of a strong and resilient design which is not prone to being stripped in the hole. The presence of the wear sleeve 26 protects the rotating drill pipe 12 from wear by the casing 14 as well as wear from the non-rotating stabilizer housing 50. Also, the casing 14 is protected from wear by the drill pipe 12.

It should be understood that while the invention has been herein shown and described in what is presently believed to be the most practical and preferred embodiment thereof, it will be apparent to those skilled in the art that many modifications may be made to the invention described while remaining within the scope of the claims.

What is claimed is:

1. A stabilizer apparatus for a rotatable tubular member, the stabilizer apparatus comprising:

a generally cylindrical metal wear sleeve having a securing member at each end to removably secure the metal wear sleeve around the rotatable tubular member;

a generally cylindrical stabilizer housing disposed radially surrounding the wear sleeve and rotatable about the wear sleeve; and first and second bushings disposed between the securing members and the rotatable tubular member.

2. The stabilizer apparatus of claim 1 wherein the stabilizer housing presents a radially outwardly extending blade.

3. The stabilizer apparatus of claim 1 wherein the wear sleeve further comprises first and second clamps around the first and second ends, respectively, securing the wear sleeve first and second bushings respectively against the rotatable tubular member.

4. The stabilizer apparatus of claim 1 wherein the stabilizer housing comprises an elastomeric jacket formed of mating semicylindrical halves, the elastomeric material having a durometer hardness reading of approximately 72.

5. The stabilizer apparatus of claim 1 wherein the stabilizer housing includes a plurality of interlacing protruding fingers containing interior channels, the interior protruding channels substantially encased in an elastomeric material, the stabilizer housing securable about the wear sleeve by a sleeve pin adapted to slide through the interior channels.

6. The stabilizer apparatus of claim 1 wherein the stabilizer jacket includes a generally cylindrical insert which has a thickness greater than a thickness of said metal wear sleeve.

7. The stabilizer apparatus of claim 1 wherein the non-elastomeric bushing comprises a first and second half disposed on opposing ends of the wear sleeve.

8. A stabilizer apparatus for metal rotatable tubular member, the stabilizer apparatus comprising:

a generally cylindrical wear sleeve removably secured to a rotatable tubular member to rotate with the tubular member, the wear sleeve being formed of two mateable semicylindrical halves;

a generally cylindrical stabilizer housing disposed radially surrounding the wear sleeve and rotatable about the wear sleeve; and a bushing disposed between the wear sleeve and the rotatable tubular member, the bushing being made of a malleable metal; and a clamp portion on the wear sleeve clamping the bushing around the metal rotatable tubular member causing the malleable metal to conform to the metal rotatable tubular member.

9. The stabilizer apparatus of claim 8 wherein the stabilizer housing is formed of two semicylindrical halves which are secured to each other in a circumferentially-surrounding relation around the wear sleeve, the stabilizer housing including a plurality of interlacing protruding fingers containing interior channels, the interior protruding channels substantially encased in an elastomeric material, the stabilizer housing securable about the wear sleeve by a sleeve pin adapted to slide through the interior channels.

10. The stabilizer apparatus of claim 8 wherein the wear sleeve comprises a wear surface portion having a first exterior circumference and the clamp portion proximate an axial end of the wear sleeve and having a second exterior circumference which is greater than the first exterior circumference, the clamp portion having an inwardly-disposed groove to accommodate a generally complimentary-shaped shoulder on the bushing.

11. The stabilizer apparatus of claim 8 wherein the stabilizer housing presents a radially-extending blade.

12. The stabilizer apparatus of claim 8 wherein the stabilizer housing comprises mating semicylindrical halves having a thickness greater than a thickness of said wear sleeve.

13. A stabilizer apparatus which is removably securable to a rotatable tubular member, the stabilizer apparatus comprising:

a generally cylindrical metal wear sleeve having a securing member at each end to radially surround a rotatable tubular member and which is formed of a relatively hard material; and a bushing disposed between each of the securing members of the wear sleeve and the rotatable tubular member and being formed of a material which is softer than that of the wear sleeve causing the bushing to conform against the rotatable tubular member as the securing member is tightened.

14. The stabilizer apparatus of claim 13 further comprising a stabilizer housing adapted to radially surround said wear sleeve, the stabilizer housing including a plurality of interlacing protruding fingers containing interior channels, the interior protruding channels substantially encased in an elastomeric material, the stabilizer housing securable about the wear sleeve by a sleeve pin adapted to slide through the interior channels.

15. The stabilizer apparatus of claim 14 wherein the stabilizer housing comprises a generally cylindrical insert having a thickness greater than a thickness of said metal wear sleeve.

16. The stabilizer apparatus of claim 15 wherein the stabilizer housing further comprises an elastomeric jacket substantially surrounding said insert, the elastomeric jacket having a durometer hardness reading of approximately 72.

17. The stabilizer apparatus of claim 16 wherein the stabilizer housing further comprises a radially extending blade.

18. The stabilizer apparatus of claim 17 wherein the blade is substantially straight.

19. The stabilizer apparatus of claim 17 wherein the blade is disposed in a spiral relation.

20. The stabilizer apparatus of claim 13 wherein the bushing is substantially formed of aluminum.

21. The stabilizer apparatus of claim 13 wherein the bushing is substantially formed of brass.

22. A stabilizer apparatus for a rotatable tubular member, the stabilizer apparatus comprising:

a generally cylindrical wear sleeve removably secured to a rotatable tubular member to rotate with the tubular member;

a securing member disposed on each end of the wear sleeve;

a generally cylindrical stabilizer housing disposed radially surrounding the wear sleeve and rotatable about the wear sleeve, the stabilizer being disposed between the securing members; and a bushing disposed inside each of the securing members of the wear sleeve so that the wear sleeve does not contact the tubular member and the securing member conforms the bushing to the rotatable tubular member.

23. The stabilizer apparatus of claim 22 in which a gap is defined between a portion of the wear sleeve and the tubular member.

24. The stabilizer apparatus of claim 22 further comprising a clamp portion that is selectively tightenable to secure the wear sleeve against the bushing.

25. A stabilizer apparatus for a rotatable tubular member, the stabilizer apparatus comprising:

a wear sleeve adapted to radially surround and be affixed against a rotatable tubular member which is formed of a relatively hard material and to rotate with the tubular member;

a first and second bushing adapted to be disposed between the wear sleeve and the rotatable member and being formed of a material which is more malleable than that of the wear sleeve; and a securing clamp that is selectively tightenable to secure the wear sleeve against the bushing.

26. The stabilizer apparatus of claim 25 wherein the clamp further comprises a threaded screw hole and a selectively insertable threaded connector which can be inserted into the hole to secure the wear sleeve in a radially surrounding relation upon the bushings, and wherein the first and second bushings are separated by a gap.

27. The stabilizer apparatus of claim 25 wherein the securing clamp comprises a first and second portion disposed on opposing ends of the wear sleeve.

* * * * *